US011761267B2

(12) United States Patent
Fox

(10) Patent No.: US 11,761,267 B2
(45) Date of Patent: Sep. 19, 2023

(54) TELEMETRY MARINE RISER

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 0 days.

(21) Appl. No.: 17/845,918

(22) Filed: Jun. 21, 2022

(65) Prior Publication Data

US 2022/0316282 A1 Oct. 6, 2022

(51) Int. Cl.

| | |
|---|---|
| ***E21B 17/01*** | (2006.01) |
| ***E21B 47/13*** | (2012.01) |
| ***E21B 17/02*** | (2006.01) |

(52) U.S. Cl.

CPC ..... *E21B 17/01* (2013.01); *E21B 17/028* (2013.01); *E21B 17/0283* (2020.05); *E21B 47/13* (2020.05)

(58) Field of Classification Search

CPC ..... E21B 17/01; E21B 17/028; E21B 47/13; E21B 17/0283; E21B 21/08; E21B 47/06; E21B 47/10; E21B 47/12; E21B 17/18; E21B 17/003

See application file for complete search history.

(56) References Cited

U.S. PATENT DOCUMENTS

| | | | | |
|---|---|---|---|---|
| 10,393,302 | B2 * | 8/2019 | Dill | F16L 23/12 |
| 10,596,605 | B1 * | 3/2020 | Carter | E21B 37/00 |
| 2002/0014340 | A1 * | 2/2002 | Johnson | E21B 17/01 175/320 |
| 2004/0219831 | A1 * | 11/2004 | Hall | H01R 13/523 439/578 |
| 2010/0007519 | A1 * | 1/2010 | Madhavan | H02G 3/0481 340/855.1 |
| 2017/0335682 | A1 * | 11/2017 | Clark | E21B 17/028 |
| 2022/0290506 | A1 * | 9/2022 | Meier | E21B 17/003 |

* cited by examiner

*Primary Examiner* — Brad Harcourt

(57) ABSTRACT

A telemetry tool comprising a tube comprising a side wall comprising an exterior side wall surface spaced a distance apart from an interior side wall surface. The tube comprises first and second flanged end connectors suitable for connecting the tube in a telemetry tool string, the tube comprising a major and minor axial bore. The minor axial bore being enclosed within the side wall. The exterior side wall surface is circular in cross section and the interior side wall surface comprises a substantially kidney shaped cross section forming a convex portion of the side wall. The minor axial bore may be enclosed within the convex portion of the side wall. The tool further comprises inductive couplers disposed within the convex portion of the side wall. Alternatively, the inductive couplers may be disposed within the end connectors. The couplers are connected by a cable running through the minor axial bore.

20 Claims, 10 Drawing Sheets

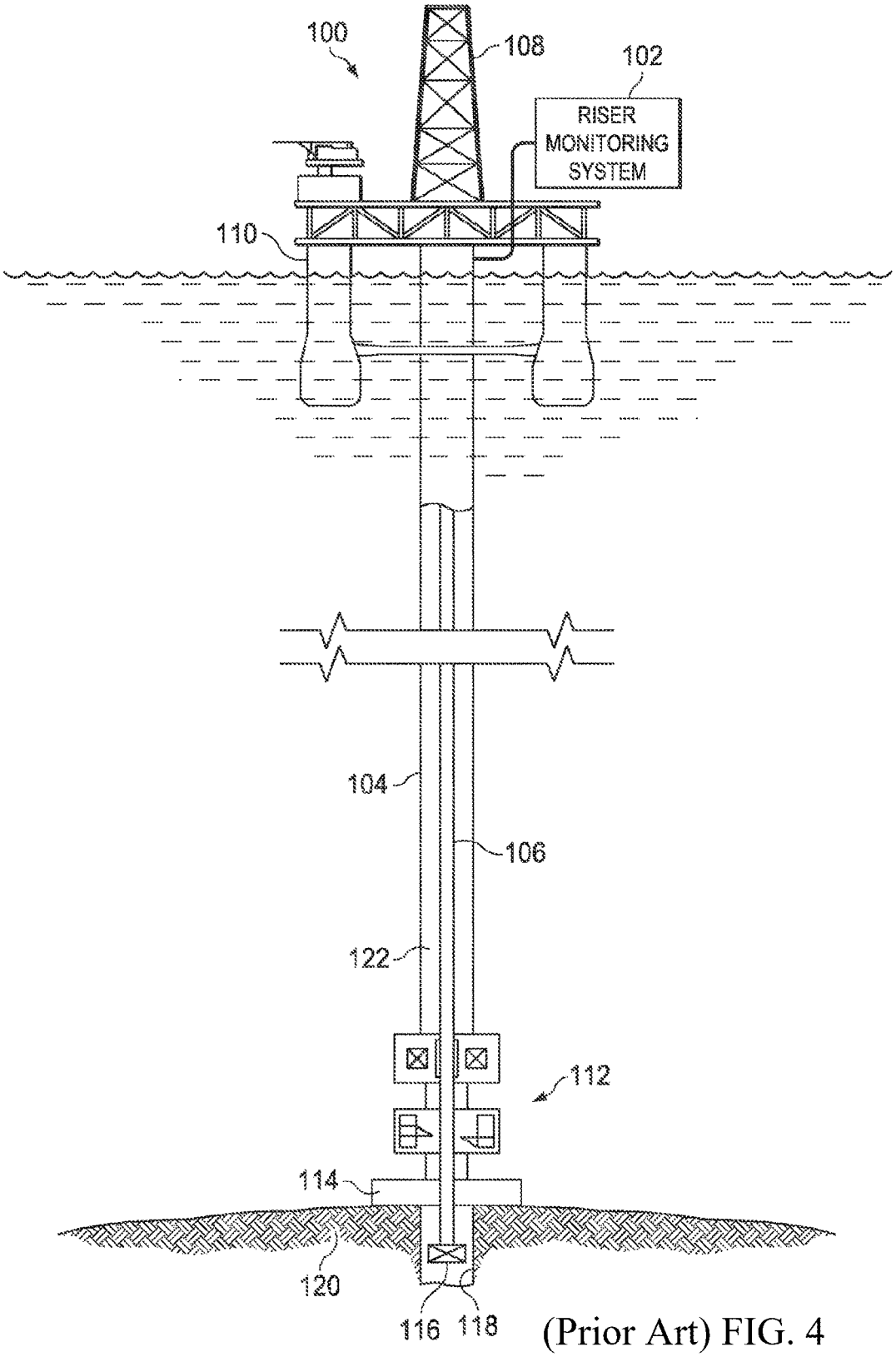
(Prior Art) FIG. 4

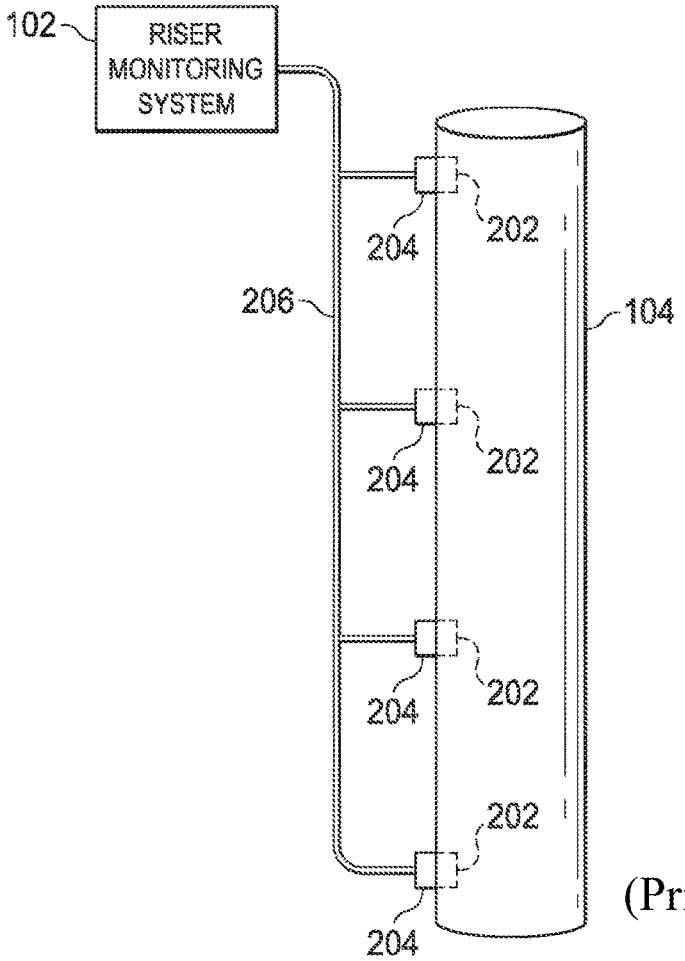
(Prior Art) FIG. 5
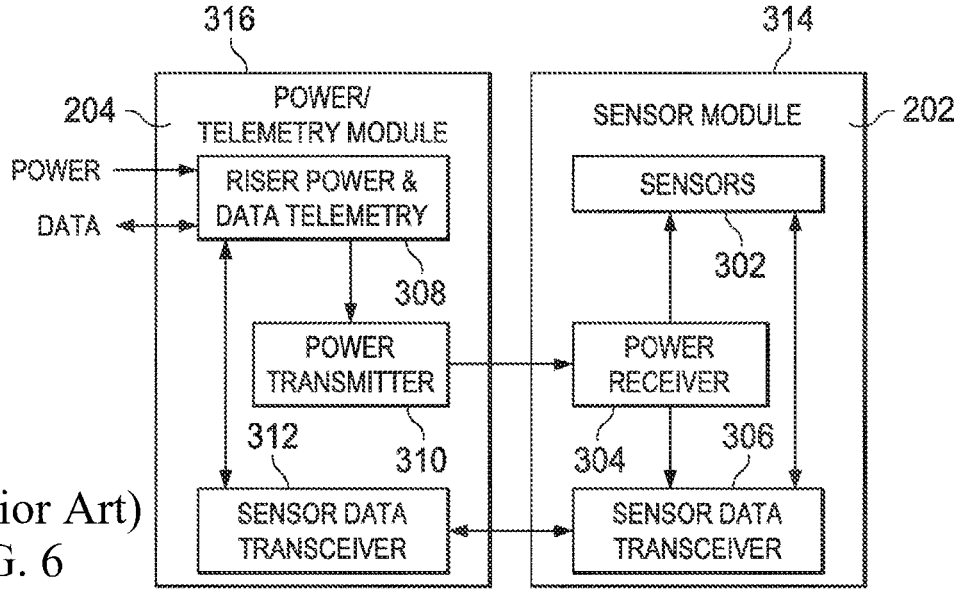
(Prior Art) FIG. 6

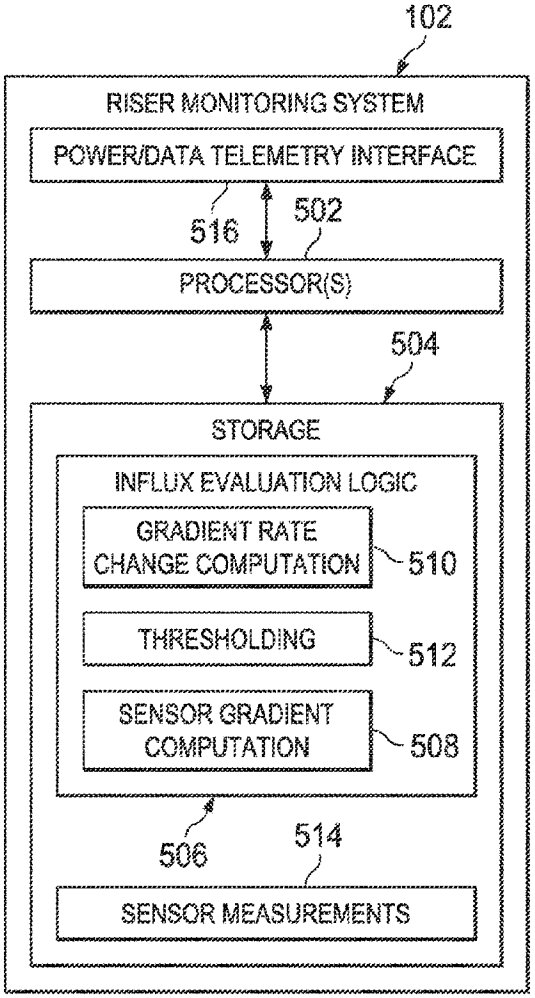
(Prior Art) FIG. 8
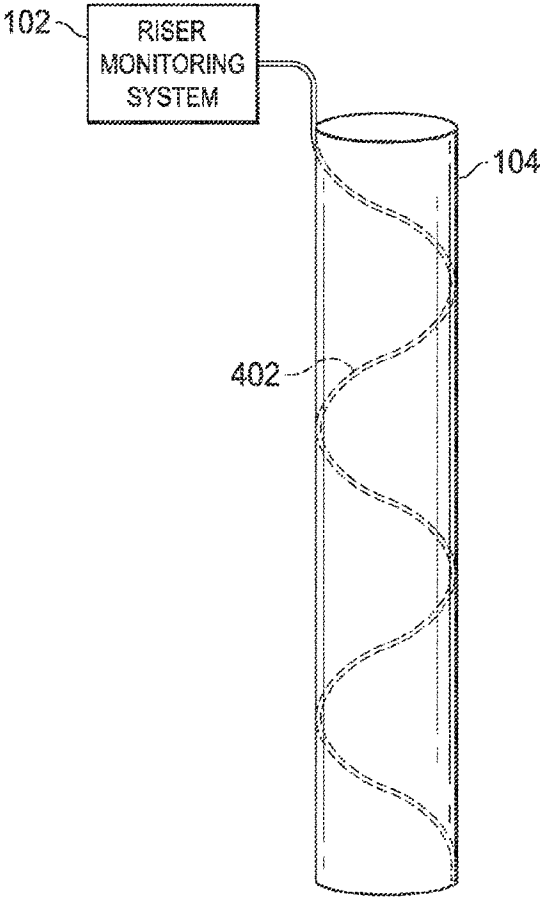
(Prior Art) FIG. 7

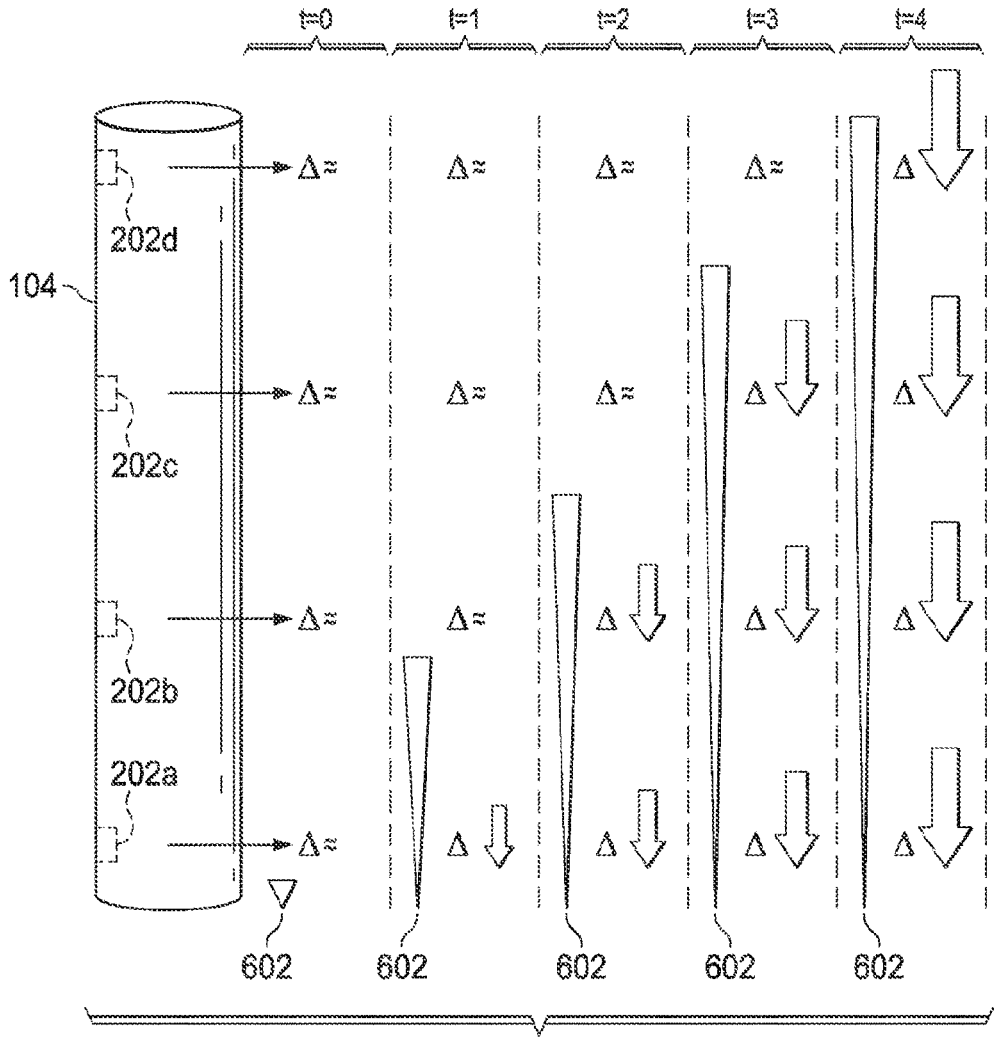
(Prior Art) FIG. 9

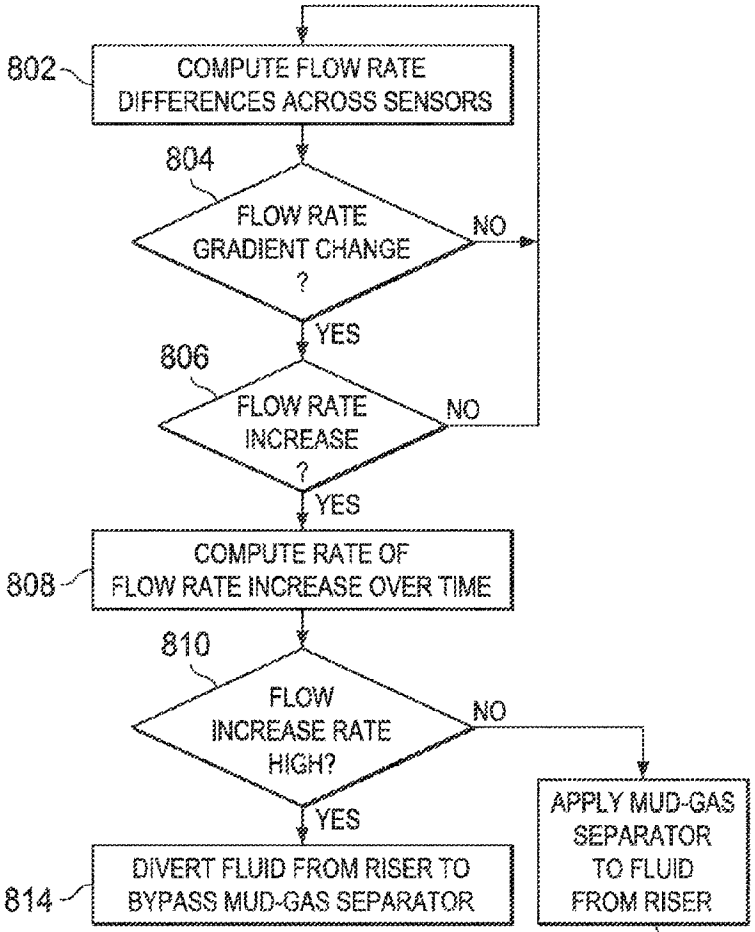
(Prior Art) FIG. 11
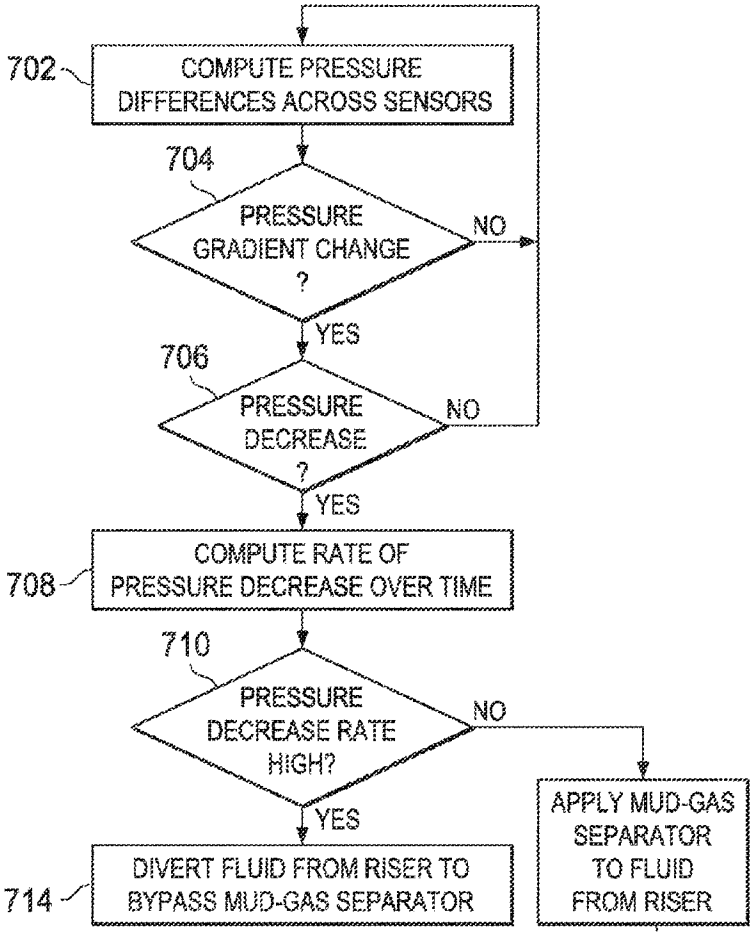
(Prior Art) FIG. 10

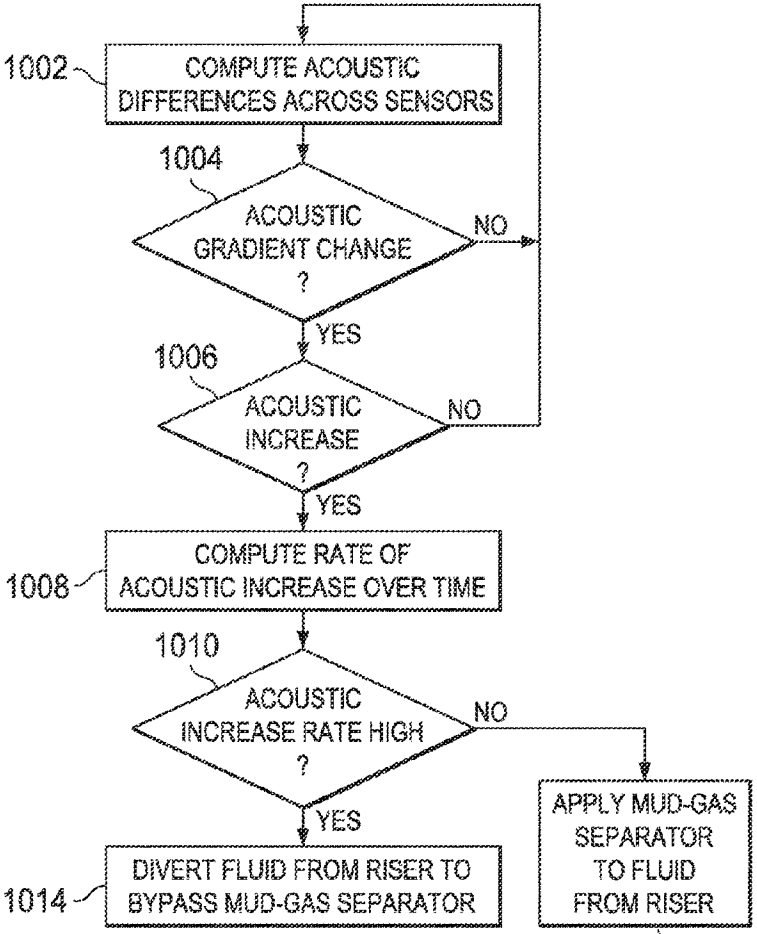
(Prior Art) FIG. 13
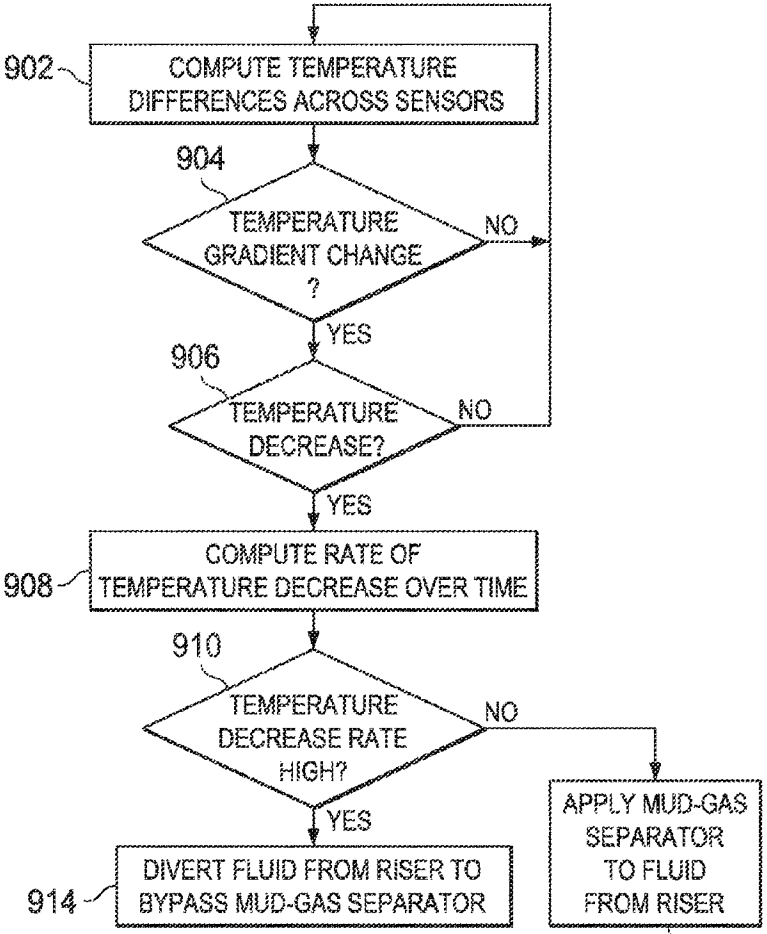
(Prior Art) FIG. 12

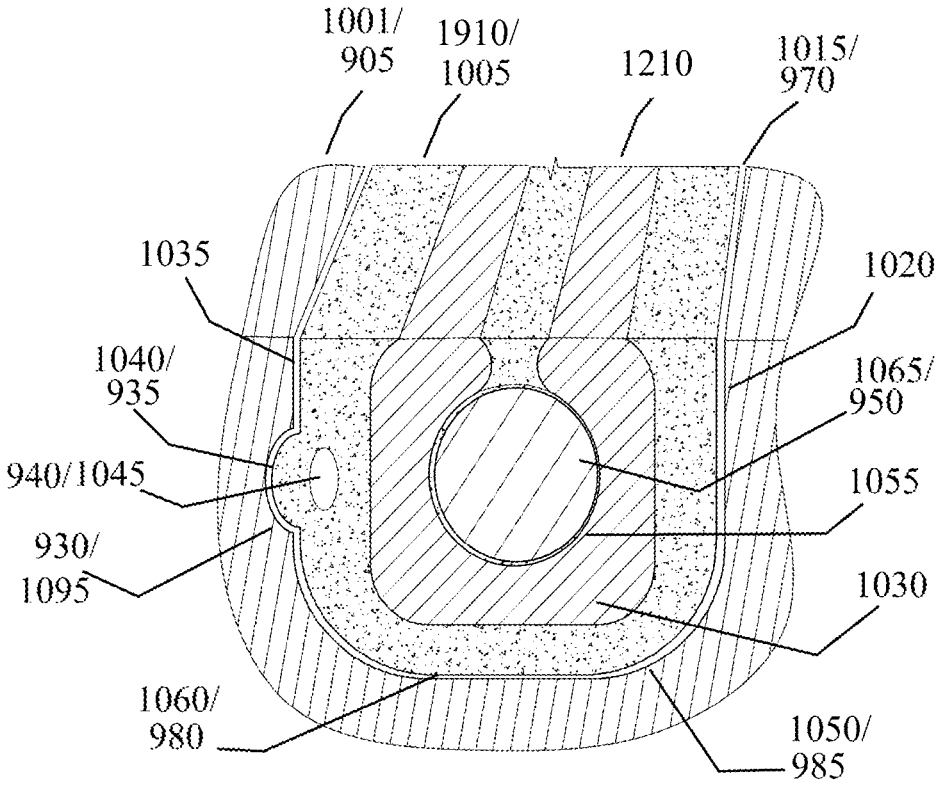
(Prior Art) FIG. 14
(From U.S. Patent Application 17/559,619)

TELEMETRY MARINE RISER

RELATED APPLICATIONS

This application presents modifications of U.S. patent application Ser. No. 13/491,736, now abandoned, entitled Wellbore Influx Detection In A Marine Riser, to Veeningen, filed Jun. 8, 2012, which is incorporated herein by this reference.

U.S. patent application Ser. No. 17/559,619, entitled Inductive Coupler for Downhole Transmission Line, to Fox, filed Dec. 22, 2021, is also incorporated herein by this reference.

BACKGROUND

When drilling a borehole through subsurface formations, a wellbore or formation fluid influx, also called a "kick", can cause an unstable and unsafe condition at the surface or rig. Consequently, it is desirable to detect a wellbore influx at the earliest possible time. When a kick is detected, the blowout preventers associated with the well may be closed and steps taken to regain control of the well.

In deepwater wells, for example, wellbore influx may sometimes migrate above the blowout preventers before the blowout preventers can be closed. Under such conditions, a mud-gas separator may be applied to the fluid (a mixture of drilling fluid and formation fluid) flowing up to the surface. The mud-gas separator extracts the gas from the drilling fluid and allows the gas to be transported away from the well, while the drilling fluid is processed for recirculation. Although less desirable, the fluid may be diverted to bypass the mud-gas separator. For example, the fluid may be diverted overboard. Use of a mud-gas separator minimizes environmental discharge of wellbore fluids, but if the fluid gas content or discharge rate from the well exceeds the mud-gas separator processing capabilities, then wellbore fluid may be diverted to bypass the mud-gas separator. Determining whether wellbore fluid flow should be diverted or processed through a mud-gas separator can be problematic. Accordingly, improved techniques for determining how wellbore influx uphole of the blowout preventers should be processed are desirable.

SUMMARY

The application presents a high speed telemetry tool to add in the detection and prevention of anomalies occurring while constructing a well and in the production of subterranean fluids. The telemetry tool may comprise a marine riser, drill pipe, bottom hole assembly, or other tools associated with a tool string for constructing a well or the production of subterranean fluids and gases.

In this portion of the summary, a telemetry tool is described in relation to FIGS. 1-3 and may comprise a tube that may comprise a side wall comprising an exterior side wall surface spaced a distance apart from an interior side wall surface. The tube may comprise a first end connector and a second end connector suitable for connecting the tube in a telemetry tool string. The interior side wall surface may form a major axial bore. The side wall may further comprise a minor axial bore that may be enclosed within the side wall. The respective axial bores may each intersect adjoining like axial bores through the first and second end connectors when the telemetry tool is attached to similarly configured telemetry tools in a tool string. The joined axial bores may provide a continuous passageway from surface equipment to the marine floor or bottom of a well. The continuous axial passageways may be suitable for use as a wave guide for the transmission of acoustic waves through air or other medium trapped within the continuous passageway.

The exterior side wall surface may be circular in cross section and the interior side wall surface may comprise a substantially kidney shaped cross section that may form a convex portion of the side wall. The convex portion may serve to strengthen the tube. The minor axial bore may be enclosed within the convex portion of the side wall. The first and second end connectors may each comprise a flange comprising an outside diameter greater than an exterior diameter of the tube. The respective flanges may each comprise a flange interface surface. The respective flange interface surfaces may each comprise an annular groove suitable for housing an inductive coupler. An exemplary inductive coupler may be shown in (Prior Art) FIG. 14. The annular groove may radially circumscribe the interior of the flange interface surface, or it may comprise a circular form such a circle, an oval, or an ellipse entirely within a portion of the flange interface surface itself. The flange interface surface may comprise a plurality of grooves that may circumscribe more than one of the connector bolt holes within the connectors.

The annular groove may serve to house the inductive coupler that may comprise an annular polymeric block comprising an MCEI trough comprising an electrically conductive wire coil disposed within the respective annular groove. An exemplary inductive coupler may be shown in (Prior Art) FIG. 14. Each of the plurality of grooves may house a separate inductive coupler.

The flanged interface surface may further comprise a wire channel connecting the annular groove with the minor axial bore. When there are a plurality of annular grooves, each one of such grooves may comprise the wire channel connecting the grooves to the minor axial bore. One or more transmission cables may be disposed within minor axial bore. Each of the cables may be connected to the inductive couplers by means of the wire channel. The cable may be connected to a similarly configured inductive coupler at the opposite end of the tube. The cable may comprise a single wire cable, coaxial cable, a twisted pair of wires, a fiber optic cable, a wireline cable, a slickline cable, or a combination of cable configurations. The respective cables may provide a means for the respective inductive couplers to be in communication with each other. The cable may comprise a single cable extending from surface equipment to subterranean equipment.

The flange interfaces may also comprise a seal gland suitable for housing an annular seal. The seal may comprise a polymeric compressive seal, metallic seal, or a natural or synthetic fiber seal. That seal gland may surround the annular groove. The seal may isolate the inductive coupler from contamination present in the subsurface environment.

The annular groove may comprise an interior surface that may be harder on the Rockwell C scale than the flanged interface surface surrounding the groove. The hardness of the interior surface may be achieved by a process of peening, such as shot peening, hammer peening, laser peening, or combination of such processes. Surface hardness may also be achieved by brinelling or by a chemical coating process.

The flanged interface may comprise a plurality of bolt holes. The bolt holes may be uniform in size or they may vary in size. The bolt holes may be arranged in an annular symmetrical pattern or they may be arranged in an annular asymmetrical pattern. Like the annular groove, the bolt hole may comprise a surface harder than the surrounding flanged interface surface. One or more of the bolt holes may be surrounded by the inductive coupler.

In an alternative embodiment of the present invention the convex portion of the side wall may comprise an annular groove surrounding the opening of the minor axial bore. The annular groove may house an inductive coupler. An exemplary inductive coupler may be shown at (Prior Art) FIG. 14. The convex portion of the side wall may comprise an annular seal gland comprising a seal disposed therein surrounding the annular groove. The annular groove, seal gland, seal, and inductive coupler may be configured like what was described in relation to the similar features as disposed within the first and second flanged connectors. Also, an inductive coupler as may be shown at (Prior Art) FIG. 14 comprising a polymeric block comprising an MCEI trough comprising an electrically conductive wire coil may be disposed within the annular groove within the convex portion of the side wall. The inductive coupler within the convex portion of the side wall may be in communication with a similarly configured inductive coupler at the opposite end of the tube by means of a cable running through the minor axial bore and the wire channel and connected to the wire coil.

The respective inductive couplers as may be shown in (Prior Art) FIG. 14 may be in communication with sensors housed within the respective end connectors. The sensors may receive measurements and provide the measurements to a riser monitoring system as may be shown at (Prior Art) FIG. 5.

The following portion of the summary is taken from the '736 reference and applies to the FIGS. 1-3 except when modified by said figures.

Methods and apparatus for managing wellbore influx in a marine riser. In one embodiment, a method for managing wellbore influx includes identifying a difference between measured values provided by a plurality of sensors longitudinally spaced along a marine riser. Whether the difference between measured values provided by a given pair of the sensors has changed relative to a difference between measured values previously provided by the given pair of the sensors is determined. Whether wellbore influx is present in the marine riser is determined based on the change in the difference.

In another embodiment, a system for managing wellbore influx includes a marine riser, an array of sensors, and influx analysis logic. The array of sensors is disposed at intervals along the length of the marine riser. The sensors are configured to measure one or more parameters indicative of wellbore influx within the marine riser. The influx analysis logic is configured to detect wellbore influx in the marine riser based on a difference in measurement values provided by two of the sensors.

In a further embodiment, a marine riser includes a plurality of riser tubes, sensors distributed along the tubes at least some of the tubes, and a riser monitoring system communicatively coupled to the sensors. The tubes are connected end-to-end and extend from a blowout preventer to a surface installation. The sensors are configured to measure a condition of fluid in the tubes. The riser monitoring system is configured to collect measurement values generated by the sensors, and to detect influx of formation fluid into the riser based on a difference between measurement values provided by two of the sensors.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form in the interest of clarity and conciseness.

FIG. 4 shows a schematic view of an offshore system including wellbore influx detection in accordance with principles disclosed herein.

FIG. 5 shows a schematic view of a marine riser configured to detect wellbore influx in accordance with principles disclosed herein.

FIG. 6 shows a block diagram of a sensor module and a power/telemetry module for monitoring conditions within a marine riser in accordance with principles disclosed herein.

FIG. 7 shows a schematic view of a marine riser that includes optical fiber sensors for detecting wellbore influx in accordance with principles disclosed herein.

FIG. 8 shows a block diagram for a riser monitoring system configured to manage wellbore influx in accordance with principles disclosed herein.

FIG. 9 schematically shows an exemplary wellbore influx occurring in a marine riser that is configured in accordance with principles disclosed herein.

FIGS. 10-13 show flow diagrams for methods for managing wellbore influx in accordance with principles disclosed herein.

FIG. 14 is a cross-section diagram of an inductive coupler of the present invention.

DETAILED DESCRIPTION

Figure 1:
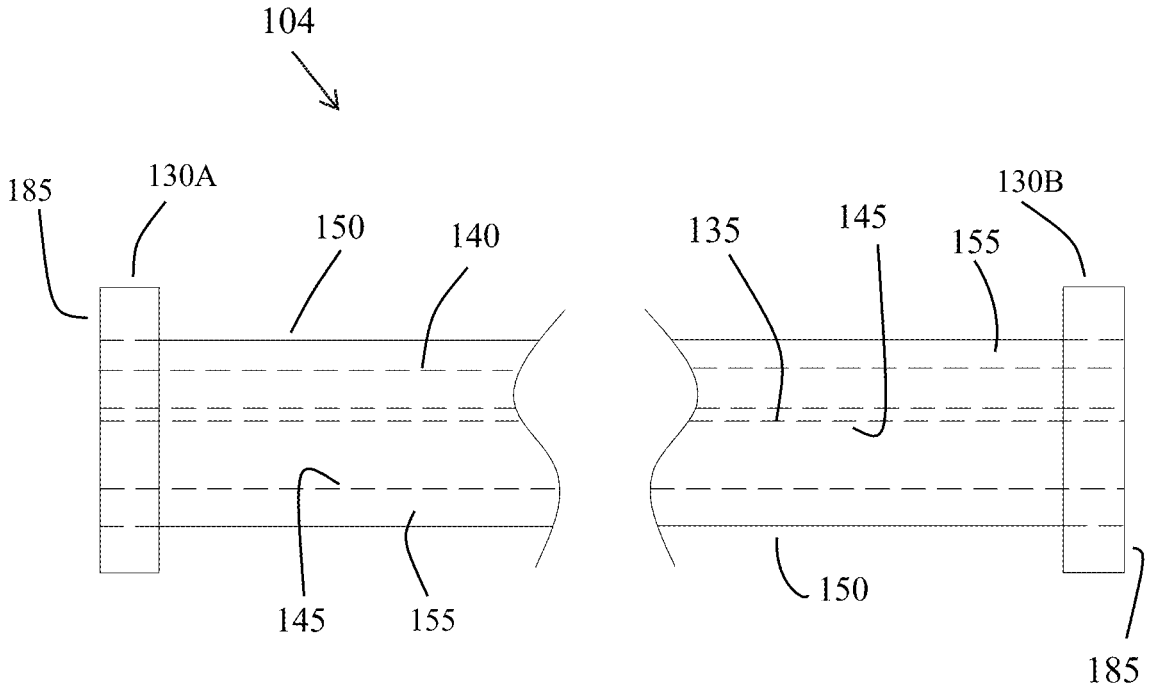
FIG. 1 is a side view diagram of a telemetry tubular of the present invention.
Figure 2:
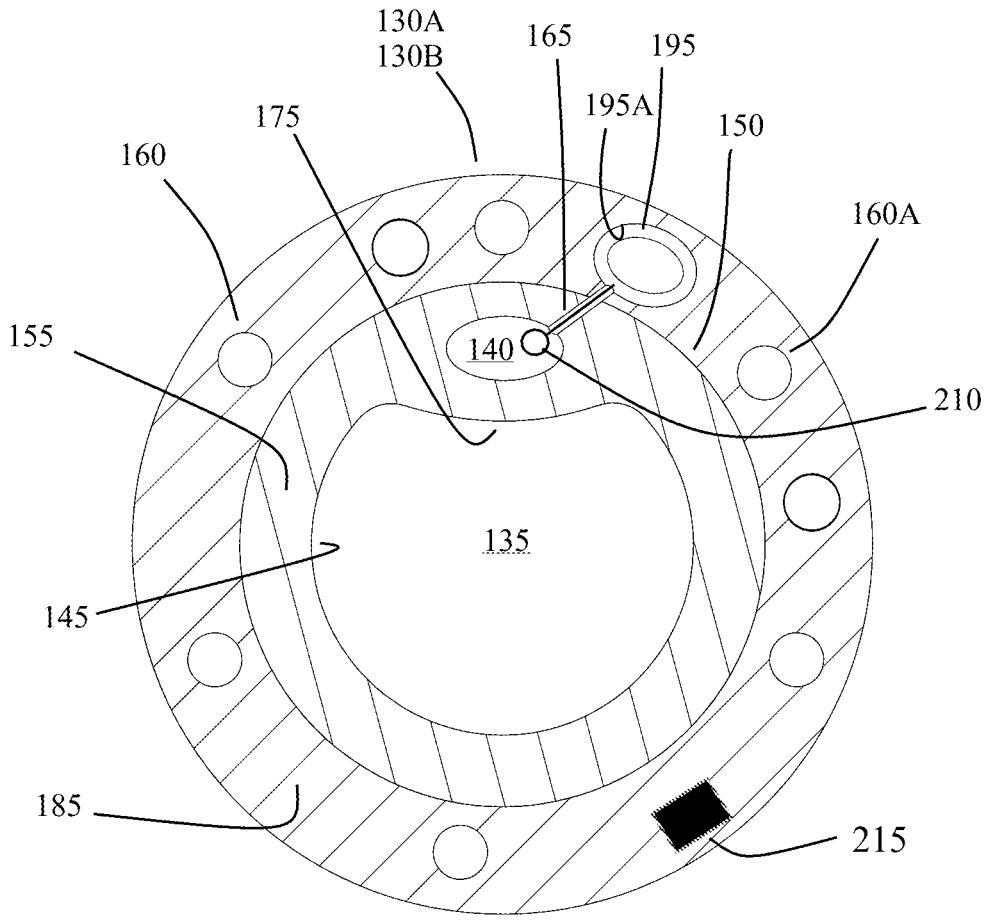
FIG. 2 is an end view diagram of a telemetry tubular of the present invention.
Figure 3:
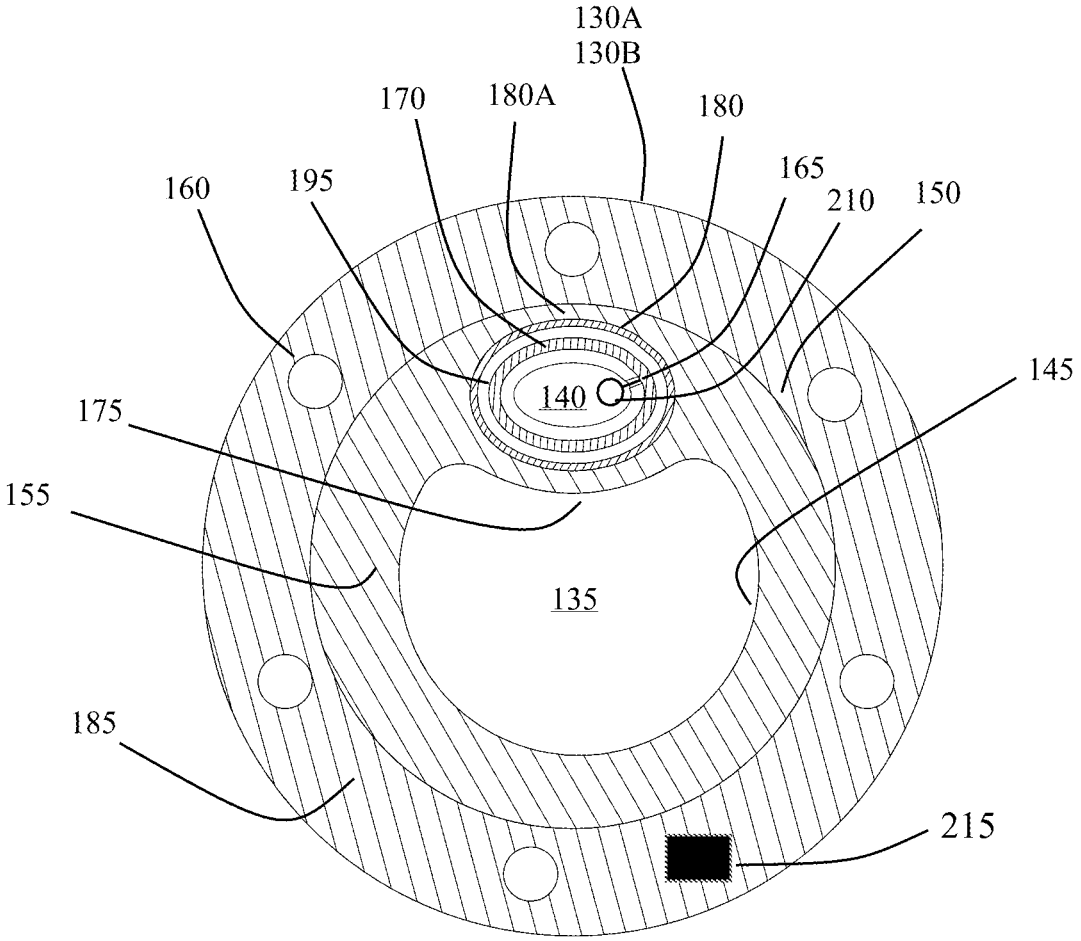
FIG. 3 is an end view diagram of a telemetry tubular of the present invention.

This portion of the detailed description is in relation to FIGS. 1-3. The application presents a telemetry tool as may be shown at 104 (Prior Art) FIG. 4. The telemetry tool may comprise a marine riser, drill pipe, bottom hole assembly, or other tools associated with a tool string for constructing a well or the production of subterranean fluids and gases.

The telemetry tool may comprise a tube 220 that may comprise a side wall 155 comprising an exterior side wall surface 150 spaced a distance apart from an interior side wall surface 145. The tube 220 may comprise a first end connector 130A and a second end connector 130B suitable for connecting the tube 220 in a telemetry tool string as shown at 104 (Prior Art) FIG. 4. The interior side wall surface 145 may form a major axial bore 135. The side wall 155 may further comprise a minor axial bore 140 that may be enclosed within the side wall 155. The respective axial bores 135/140 may each intersect adjoining like axial bores through the first 130A and second 130B end connectors when the telemetry tool is attached to similarly configured telemetry tools in a tool string. The joined axial bores 135/140 may provide a continuous passageway from surface equipment to the marine floor or bottom of a well. The continuous axial passageways may be suitable for use as a wave guide for the transmission of acoustic waves through air or other medium trapped within the continuous passageway.

The exterior side wall surface 150 may be circular in cross section and the interior side wall surface 145 may comprise a substantially kidney shaped cross section that may form a convex portion 175 of the side wall 155. The convex portion 175 may serve to strengthen the tube 220. The minor axial bore 140 may be enclosed within the convex portion 175 of the side wall 155. The first 130A and second 130B end connectors may each comprise a flange 130A/130B comprising an outside diameter greater than an exterior diameter of the tube 220. The respective flanges may each comprise a flange interface surface 185. The respective flange interface surfaces 185 may each comprise an annular groove 195 suitable for housing an inductive coupler 170. An exemplary inductive coupler may be shown in (Prior Art) FIG. 14. The annular groove 195 may radially circumscribe the interior of the flange interface surface (not shown) 185, or it may comprise a circular form such a circle, an oval, or an ellipse entirely within a portion of the flange interface surface 185 itself as may be shown at 195. The flange interface surface 185 may comprise a plurality of grooves 195 that may circumscribe more than one of the connector bolt holes 160/160A within the connectors 130A/130B.

The annular groove 195 may serve to house the inductive coupler 170 that may comprise an annular polymeric block comprising an MCEI trough comprising an electrically conductive wire coil disposed within the respective annular groove 195. An exemplary inductive coupler may be shown in (Prior Art) FIG. 14. Each of the plurality of grooves 195 may house a separate inductive coupler 170.

The flanged interface surface 185 may further comprise a wire channel 165 connecting the annular groove 195 with the minor axial bore 140. When there are a plurality of annular grooves 195, each such grooves may comprise the wire channel connecting the grooves to the minor axial bore 140. One or more a transmission cables 210 may be disposed within minor axial bore. Each of the cables 210 may be connected to the inductive couplers 170 by means of the wire channel 165. The cable 210 may be connected to a similarly configured inductive coupler 170 at the opposite end of the tube 220. The cable 210 may comprise a coaxial cable, a twisted pair of wires, a fiber optic cable, a wireline cable, a slickline cable, or a combination of cable configurations. The respective cables 210 may provide a means for the respective inductive couplers to be in communication with each other.

The flange interfaces 185 may also comprise a seal gland 180A suitable for housing an annular seal 180. The seal 180 may comprise a polymeric compressive seal, metallic seal, or a natural or synthetic fiber seal. That seal gland 180A may surround the annular groove 195. The seal 180 may isolate the inductive coupler 170 from contamination present in the subsurface environment.

The annular groove 195 may comprise an interior surface 195A that may be harder on the Rockwell C scale than the flanged interface surface 185 surrounding the groove 195. The hardness of the interior surface 195A may be achieved by a process of peening, such as shot peening, hammer peening, laser peening, or combination of such processes. Surface hardness may also be achieved by brinelling or by a chemical coating process.

The flanged interface 185 may comprise a plurality of bolt holes 160. The bolt holes 160 may be uniform in size or they may vary in size. The bolt holes 160 may be arranged in an annular symmetrical pattern 160 or they may be arranged in an annular asymmetrical pattern 160A. Like the annular groove 195, the bolt hole may comprise a surface harder than the surrounding flanged interface surface 185. One or more of the bolt holes may be surrounded by a groove 195 housing the inductive coupler 170.

In an alternative embodiment of the present invention the convex portion 175 of the side wall 155 may comprise an annular groove 195 surrounding the opening of the minor axial bore 140. The annular groove 195 may house an inductive coupler 170. An exemplary inductive coupler may be shown at (Prior Art) FIG. 14. The convex portion 175 of the side wall 155 may comprise an annular seal gland 180A comprising a seal 180 disposed therein surrounding the annular groove 195. The annular groove, seal gland, seal, and inductive coupler may be configured like what was described in relation to the similar features as disposed within the first and second flanged connectors 130A/130B. Also, an inductive coupler 170 as may be shown at (Prior Art) FIG. 14 comprising a polymeric block comprising an MCEI trough comprising an electrically conductive wire coil may be disposed within the annular groove 195 within the convex portion 175 of the side wall 155 The inductive coupler 170 within the convex portion 175 of the side wall 155 may be in communication with a similarly configured inductive coupler 170 at the opposite end of the tube 220 by means of a cable 210 running through the minor axial bore 140 and the wire channel 165 and connected to the wire coil as may be shown in (Prior Art) FIG. 14.

The respective inductive couplers as may be shown in (Prior Art) FIG. 14 may be in communication with sensors 215 housed within the respective end connectors 130A/130B. The sensors 215 may receive measurements and provide the measurements to a riser monitoring system as may be shown at (Prior Art) FIG. 5.

The following portion of the detailed description is taken from the '736 reference and applies to FIGS. 1-3 except when modified by said figures.

The following discussion is directed to various exemplary embodiments of the invention. The embodiments disclosed should not be interpreted, or otherwise used, to limit the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Conventional influx management techniques rely on surface measurements to determine the condition of fluid circulating through the wellbore. Unfortunately, surface measurements may fail to provide adequate and/or timely information regarding wellbore influx. More specifically, the surface measurements may not provide sufficient information to allow a well control system to determine whether fluid should be diverted to bypass a mud-gas separator (e.g., diverted overboard) or processed through the mud-gas separator. Embodiments of the present disclosure advantageously provide real-time measurement of fluid condition from sensors distributed along the marine riser. Based on the measurements made along the riser, embodiments can determine the nature of wellbore influx present in the riser, and determine whether the fluid discharged from the riser should be diverted or processed through a mud-gas separator.

(Prior Art) FIG. 4 shows a schematic view of an offshore system 100 including wellbore influx detection in accordance with principles disclosed herein. Embodiments of the system 100 may be used to drill and/or produce the wellbore 118. The system 100 includes an offshore platform 110 equipped with a derrick 108 that supports a hoist (not shown) for raising and/or lowering a tubing string 106, such as a drill string. A marine riser 104 extends from the platform 110 to a subsea blowout preventer (BOP) 112. The BOP 112 is disposed atop a wellhead 114 at the seafloor. The wellbore 118 extends from the wellhead 114 into the earthen formations 120.

The tubing string 106 may include drill pipe, production tubing, coiled tubing, etc., and extends from the platform 110 through the riser 104, the BOP 112, and the wellhead 114 into the wellbore 118. A downhole tool 116 is connected to the lower end of the tubing string 106 for carrying out operations in the wellbore 118. The downhole tool 116 may include any tool suitable for performing downhole operations such as, drilling, completing, evaluating, and/or producing the wellbore 118. Such tools may include drill bits, packers, testing equipment, perforating guns, and the like. During downhole operations, tubing string 106 and tool 116 may move axially, radially, and/or rotationally relative to the riser 104 and the BOP 112.

The BOP 112 is configured to controllably seal the wellbore 118. Some embodiments of the BOP 112 may engage and seal around the tubing string 106, thereby closing off the annulus between the tubing string 106 and the riser 104. Some embodiments of the BOP 112 may include shear rams or blades for severing the tubing string 106 and sealing off wellbore 118 from riser 104. Transitioning the BOP 112 from open to closed positions and vice versa may be controlled from the surface or subsea.

The riser 104 includes multiple riser sections or joints of riser tubing connected end to end. Drilling fluid is circulated down to the wellbore 118 through the tubing string 106, and back to the platform 118 through the annulus 122 formed between the interior wall of the riser 104 and the tubing string 106. If formation fluids flow into the wellbore 118, the formation fluids may propagate to the surface via the annulus 122.

Embodiments of the riser 104 disclosed herein include sensors distributed along the length of the riser 104. The sensors detect conditions within the annulus 122 that may be indicative of the presence and degree of wellbore influx flowing into the riser 104. Information from the sensors is provided, via a riser telemetry system, to a riser monitoring system 102. The riser monitoring system 102 processes the measurements to determine whether, and what amount of wellbore influx is present in the annulus 122. If the riser monitoring system 102 detects wellbore influx in the annulus 122, then the riser monitoring system 102 may determine whether the fluid discharged from the riser 104 can be processed through a mud-gas separator on the platform 110. The mud-gas separator extracts gas from the drilling fluid, but has limited fluid processing and gas extraction capacity. Gas in excess of mud-gas separator capacity may be released into the atmosphere proximate the platform 110 increasing the risk of uncontrolled ignition. Accordingly, if the riser monitoring system 102 detects an amount of wellbore influx in the annulus 122 that exceeds the capacity of the mud-gas separator, then the riser monitoring system 102 may determine that the drilling fluid discharged from the riser 104 should be diverted overboard or otherwise bypass the mud-gas separator rather than processed in the mud-gas separator.

(Prior Art) FIG. 5 shows a schematic view of an embodiment of the marine riser 104. In the embodiment of (Prior Art) FIG. 5, the riser 104 includes a plurality of sensor modules 202, longitudinally spaced along the interior of the riser 104, and a plurality of power/telemetry modules 204 spaced along the exterior of the riser 104. The sensor modules 202 measure conditions on the interior of the riser 104. In some embodiments, the sensor modules 202 transmit the measurements through the wall of the riser 104 to the power/telemetry modules 204. The sensor modules 202 and the power/telemetry modules 204 may communicate magnetically through the wall of the riser 204. The power/telemetry modules 204 provide measurements received from the sensor modules 202 to the riser monitoring system 102 via a telemetry network 206 (e.g., a conductive or optical signal communication network). The sensor modules 202 and/or the power/telemetry modules 204 may be installed at manufacture of the tubes of the riser 104, or installed during or after assembly of the riser 104 at the wellsite. The sensor modules 202 may be fixed to the interior wall of the riser 104 via magnets or other suitable retention devices.

(Prior Art) FIG. 6 shows a block diagram of the sensor module 202 and the power telemetry module 204 in accordance with various embodiments. The sensor module 202 includes sensors 302, a power receiver 304, and a data transceiver 306. The sensors 302 include one or more different types of sensors 302 that measure conditions within the annulus 122. For example, the sensors 302 may include one or more of temperature sensors, pressure sensors, flow rate sensors, acoustic sensors, resistivity sensors, etc. The power receiver 304 receives power signals wirelessly transmitted through the wall of the marine riser 104 from the power/telemetry module 204, and provides power to the sensors 302, the data transceiver 306, and other components of the sensor module 202. The data transceiver 306 receives measurement values from the sensors 302 and provides the measurement values to the power/telemetry module 204 wirelessly through the wall of the riser 104. The data transceiver 306 may also receive information (e.g., commands) from the power/telemetry module 204 and provide the received information to other components of the sensor module 202. The sensor module 202 may be disposed in a housing or encapsulant 314 suitable to allow for operation of the sensor module 202 in the annulus 122.

The power/telemetry module 204 includes a riser power and data telemetry interface 308, a power transmitter 310, and a data transceiver 312. The riser power and data telemetry interface 308 is coupled to the power/data network 206 that distributes power along the exterior of the riser 104 and provides communication with the riser monitoring system 102. The riser power and data telemetry interface 308 receives power signals from the network 206 and provides power to the power transmitter 310, the data transceiver 312 and other components of the power/telemetry module 204. The power transmitter 310 receives power signals from the riser power and data telemetry interface 308 and wirelessly transmits power signals to the sensor module 202 through the wall of the riser 104. The data transceiver 312 receives measurement values wirelessly transmitted through the riser wall 104 by the sensor module 202, and provides the measurement values to the riser power and data telemetry interface 308 for transmission to the riser monitoring system 102. The power/telemetry module 204 is disposed in a housing or encapsulant 316 suitable for operation of the power/telemetry module 204 in the marine environment surround the riser 104. In some embodiments, the power/telemetry module 204 may be implemented as separate power and telemetry modules.

In some embodiments, the power transmitter 310 and the power receiver 304 are configured to pass signals magnetically through the wall of the riser 104 (e.g., the power transmitter 310 and the power receiver 304 are inductively coupled). Similarly, the data transceivers 306 and 312 may be configured to pass signals magnetically through the wall of the riser 104. Thus, the power transmitter 310, power receiver 304, and data transceivers 306, 312 may include coils or other antennas, modulators, demodulators, etc. that provide transmission and/or reception of magnetic signals through the wall of the riser 104. Power and data signals may be provided in different frequency bands. In some embodiments, the power transmitter 310 and the data transceiver 312 may be combined, and/or the power receiver 304 and the data transceiver 306 may be combined.

(Prior Art) FIG. 7 shows a schematic view of a marine riser 104 that includes optical fiber sensors for detecting wellbore influx. In the embodiment shown in (Prior Art) FIG. 7, the riser 104 includes one or more optical fibers 402 extending along the length of the riser tubes. In various embodiments, the optical fibers 402 may be affixed to either the inside of the riser tubes or the outside of the riser tubes after the riser tubes have been installed at the wellsite. The optical fibers 402, and any buffering, coating, or housing protecting the optical fibers 402, may be attached to the wall of the riser 104 magnetically, or via an alternative retention technique suitable for subsea or in-riser use. The optical fibers 402 may be arranged to form a helix about the interior or exterior of the riser tubes in some embodiments.

The optical fibers 402 may be configured to provide temperature sensing, pressure sensing, acoustic sensing, etc. The optical fibers 402 reflect a portion of the light transmitted through the optical fibers 402 from the surface (e.g., a light source (e.g., laser) associated with the riser monitoring system 102). The light reflected by the optical fibers 402 is a function of environmental factors, such as temperature, pressure, or strain, that affect the optical fibers 402. Consequently, changes in the temperature, pressure, strain, etc., can be identified via analysis of changes in the reflected light. The reflections are analyzed and measurement values are derived (e.g., temperature values, pressure values, flow values, etc.).

The optical fibers 402 may implement any of various optical sensing techniques. In Distributed Temperature Sensing (DTS), the entire length of the optical fiber 402 acts as a sensor. Reflections of a light pulse transmitted down the optical fiber 402 from the surface are analyzed by the riser monitoring system 102 to determine the temperature at various locations along the riser 104. In Array Temperature Sensing (ATS), the optical fiber 402 includes Bragg gratings at predetermined measurement locations. Temperature, pressure, strain, etc. affect the Bragg gratings and in turn affect the light reflected by the Bragg gratings. Light reflected by each of the Bragg gratings is analyzed and temperature, pressure, etc. at the Bragg grating is determined by the riser monitoring system 102.

(Prior Art) FIG. 8 shows a block diagram of the riser monitoring system 102. The riser monitoring system 102 includes one or more processors 502, storage 504, and a power/data telemetry interface 516. The power/data telemetry interface 516 may include power supplies that provide power for use by the sensor modules 202 and/or the power/telemetry modules 204, and transceivers for transmitting to and receiving information from (e.g., measurement values) the sensor modules 202 and/or the power/telemetry modules 204. In embodiments employing optical fiber sensors, the interface 516 may include light sources and reflection detectors.

The processor(s) 502 may include, for example, one or more general-purpose microprocessors, digital signal processors, microcontrollers, or other suitable instruction execution devices known in the art. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The storage 504 is a non-transitory computer-readable storage device and includes volatile storage such as random access memory, non-volatile storage (e.g., a hard drive, an optical storage device (e.g., CD or DVD), FLASH storage, read-only-memory), or combinations thereof. The storage 504 includes sensor measurements 514 received from the sensor modules 202 or the optical fiber 402, and influx analysis logic 506. The influx analysis logic 506 includes instructions for processing the sensor measurements 514 and determining whether the sensor measurements 514 indicate that formation fluid is present in the marine riser 104. Processors execute software instructions. Instructions alone are incapable of performing a function. Therefore, any reference herein to a function performed by software instructions, or to software instructions performing a function is simply a shorthand means for stating that the function is performed by a processor executing the instructions. In some embodiments, at least some portions of the riser monitoring system 102 (e.g., the processors 502 and/or the storage 504) may be embodied in a computer, such as a rackmount computer, desktop computer, or other computing device known in the art.

The influx analysis logic 506 includes sensor gradient computation 508, gradient rate change computation 510, and thresholding 512. The sensor gradient computation 508 identifies differences or gradients in measured values provided by pairs of the sensor modules 202. For example, the riser system of (Prior Art) FIG. 5 includes four sensor modules 202. From the four sensor modules 202, the sensor gradient computation 508 may determine measured value differences for six different pairings of the four sensor modules 202, determine the direction of any changes in measurement value differential for the pairings, and determine whether the direction of change is indicative of wellbore influx.

The gradient rate change computation 508 determines a rate of change of a measured value difference between sensor module 202 pairings based on current and previously measured values. The thresholding 512 compares the determined rate of change to a threshold value. The results of the threshold value comparison may indicate an action to be taken to process the wellbore influx. For example, if the determined rate exceeds the threshold, then fluid discharged from the riser 104 may be diverted (e.g., diverted overboard), otherwise, the mud-gas separator may be applied.

(Prior Art) FIG. 9 illustrates influx of formation fluid into the wellbore and the marine riser 104. In (Prior Art) FIG. 7, the riser 104 includes four sensor modules 202, labeled 202*a*-202*d*. At time t=0, formation fluid 602 enters the wellbore, but an influx or kick is not yet detected because the influx is below the deepest or lowermost sensor 202*a*. At t=1, the deepest or lowermost positioned annular sensor 202*a* is the first sensor to measure, for example, a pressure decrease. At t=2, as the formation fluid 602 expands and additional formation fluid 602 enters the wellbore, the second deepest annular pressure sensor 202*b* measures an annular pressure decrease. In addition, the gradient between sensors 202*a* and 202*b* is increasing. At t=3, the sensor module 202*c* higher in the riser 104 measures a further increasing pressure drop, and the gradients between all the sensor modules continue to increase. At t=4, the sensor module 202*d* highest in the riser 104 measures a pressure drop, and the annular pressure and gradients between all the sensor modules 202*a*-202*d* increase rapidly.

(Prior Art) FIG. 10 shows a flow diagram for a method 700 for managing wellbore influx in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 700 can be performed by the processor(s) 502 of the riser monitoring system 102 executing instructions read from a computer-readable medium (e.g., storage 504). In the method 700 the marine riser 104 is installed between the platform 110 and the BOP 112. The sensor modules 202 and the power/telemetry modules 204 have been installed on the riser 104 along with telemetry network 206 that communicatively couples the sensor modules 202 to the riser monitoring system 102. Optical fiber sensors 402 may be used in some embodiments. In the method 700, wellbore influx into the riser 104 is detected based on changes in pressure in the annulus 122.

In block 702, sensor modules 202 measure the pressure in the annulus 122 of the riser 104 and provide the measurement values to the riser monitoring system 102. The riser monitoring system 102 computes the pressure difference across all pairings of sensor modules 202.

In block 704, the riser monitoring system 102 determines whether the pressure differences (i.e., gradients) have changed from those of a previous measurement (i.e., have changed over time). In some embodiments the riser monitoring system 102 determines whether the change exceeds a predetermined threshold. If no change, or insufficient change, is detected, then monitoring continues in block 702.

If change in inter-sensor module pressure difference is detected, then in block 706, the riser monitoring system 102 determines whether the pressure is decreasing over time. If the pressure is increasing rather than decreasing, the monitoring continues in block 702. If the pressure is decreasing, then the riser monitoring system 102 determines the rate of pressure decrease over time in block 708.

In block 710, the riser monitoring system 102 compares the rate of pressure decrease to a pressure decrease rate threshold value. The pressure decrease rate threshold value may be related to an amount of gas that the mud-gas separator can process. If the rate of pressure decrease exceeds the threshold value, then, in block 714, the riser monitoring system 102 may divert the fluid flow from the riser 104 to bypass the mud-gas separator (e.g., divert the fluid overboard). If the rate of pressure decrease does not exceed the threshold value, then the riser monitoring system 102 may direct the fluid flow from the riser 104 to be processed by the mud-gas separator in block 712.

(Prior Art) FIG. 11 shows a flow diagram for a method 800 for managing wellbore influx in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 800 can be performed by the processor(s) 502 of the riser monitoring system 102 executing instructions read from a computer-readable medium (e.g., storage 504). In the method 800 the marine riser 104 is installed between the platform 110 and the BOP 112. The sensors modules 202 and the power/telemetry modules 204 have been installed on the riser 104 along with telemetry network 206 that communicatively couples the sensor modules 202 to the riser monitoring system 102. Optical fiber sensors 402 may be used in some embodiments. In the method 800, wellbore influx into the riser 104 is detected based on changes in flow level in the annulus 122.

In block 802, sensor modules 202 measure the flow in the annulus 122 of the riser 104 and provide the measurement values to the riser monitoring system 102. For example, a self-heating thermistor may be used to measure flow based on changes in thermistor resistance caused by changes in thermistor heat dissipation due to changes in flow about the thermistor. The riser monitoring system 102 computes the flow difference across all pairings of sensor modules 202.

In block 804, the riser monitoring system 102 determines whether the flow differences (i.e., gradients) have changed from those of a previous measurement. In some embodiments the riser monitoring system 102 determines whether the change exceeds a predetermined threshold. If no change, or insufficient change, is detected, then monitoring continues in block 802.

If change in inter-sensor module flow difference is detected, then in block 806, the riser monitoring system 102 determines whether the flow is increasing over time. If the flow is decreasing rather than increasing, then monitoring continues in block 802. If the flow is increasing, then the riser monitoring system 102 determines the rate of flow increase over time in block 808.

In block 810, the riser monitoring system 102 compares the rate of flow increase to a flow increase rate threshold value. The flow increase rate threshold value may be related to an amount of gas that the mud-gas separator can process. If the rate of flow increase exceeds the threshold value, then, in block 814, the riser monitoring system 102 may divert the fluid flow from the riser 104 to bypass the mud-gas separator (e.g., divert the fluid overboard). If the rate of flow increase does not exceed the threshold value, then the riser monitoring system 102 may direct the fluid flow from the riser 104 to be processed by the mud-gas separator in block 812.

(Prior Art) FIG. 12 shows a flow diagram for a method 900 for managing wellbore influx in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 900 can be performed by the processor(s) 502 of the riser monitoring system 102 executing instructions read from a computer-readable medium (e.g., storage 504). In the method 900 the marine riser 104 is installed between the platform 110 and the BOP 112. The sensors modules 202 and the power/telemetry modules 204 have been installed on the riser 104 along with telemetry network 206 that communicatively couples the sensor modules 202 to the riser monitoring system 102. In the method 900, wellbore influx into the riser 104 is detected based on changes in temperature in the annulus 122.

In block 902, sensor modules 202 measure the temperature in the annulus 122 of the riser 104 and provide the measurement values to the riser monitoring system 102. The riser monitoring system 102 computes the temperature difference across all pairings of sensor modules 202.

In block 904, the riser monitoring system 102 determines whether the temperature differences (i.e., gradients) have changed from those of a previous measurement. In some embodiments, the riser monitoring system 102 determines whether the change exceeds a predetermined threshold. If no change, or insufficient change, is detected, then monitoring continues in block 902.

If change in inter-sensor module temperature difference is detected, then in block 906, the riser monitoring system 102 determines whether the temperature is decreasing over time. If the temperature is increasing rather than decreasing, then monitoring continues in block 902. If the temperature is decreasing, then the riser monitoring system 102 determines the rate of temperature decrease over time in block 908.

In block 910, the riser monitoring system 102 compares the rate of temperature decrease to a temperature decrease rate threshold value. The temperature decrease rate threshold value may be related to an amount of gas that the mud-gas separator can process. If the rate of temperature decrease exceeds the threshold value, then, in block 914, the riser monitoring system 102 may divert the fluid flow from the riser 104 to bypass the mud-gas separator (e.g., divert the fluid overboard). If the rate of temperature decrease does not exceed the threshold value, then the riser monitoring system 102 may direct the fluid flow from the riser 104 to be processed by the mud-gas separator in block 912.

(Prior Art) FIG. 13 shows a flow diagram for a method 1000 for managing wellbore influx in accordance with principles disclosed herein. Though depicted sequentially as a matter of convenience, at least some of the actions shown can be performed in a different order and/or performed in parallel. Additionally, some embodiments may perform only some of the actions shown. At least some of the operations of the method 1000 can be performed by the processor(s) 502 of the riser monitoring system 102 executing instructions read from a computer-readable medium (e.g., storage 504). In the method 1000 the marine riser 104 is installed between the platform 110 and the BOP 112. The sensors modules 202 and the power/telemetry modules 204 have been installed on the riser 104 along with telemetry network 206 that communicatively couples the sensor modules 202 to the riser monitoring system 102. In the method 1000, wellbore influx into the riser 104 is detected based on changes in acoustic pressure in the annulus 122.

In block 1002, sensor modules 202 measure the acoustic pressure in the annulus 122 of the riser 104 and provide the measurement values to the riser monitoring system 102. The riser monitoring system 102 computes the acoustic pressure difference across all pairings of sensor modules 202.

In block 1004, the riser monitoring system 102 determines whether the acoustic pressure differences (i.e., gradients) have changed from those of a previous measurement. In some embodiments the riser monitoring system 102 determines whether the change exceeds a predetermined threshold. If no change, or insufficient change, is detected, then monitoring continues in block 802.

If change in inter-sensor module acoustic pressure difference is detected, then in block 1006, the riser monitoring system 102 determines whether the acoustic level is increasing. If the acoustic pressure is decreasing rather than increasing, then monitoring continues in block 1002. If the acoustic pressure is increasing, then the riser monitoring system 102 determines the rate of acoustic pressure increase over time in block 1008.

In block 1010, the riser monitoring system 102 compares the rate of acoustic pressure increase to an acoustic pressure increase rate threshold value. The acoustic pressure increase rate threshold value may be related to an amount of gas that the mud-gas separator can process. If the rate of acoustic pressure increase exceeds the threshold value, then, in block 1014, the riser monitoring system 102 may divert the fluid flow from the riser 104 to bypass the mud-gas separator (e.g., divert the fluid overboard). If the rate of acoustic pressure increase does not exceed the threshold value, then the riser monitoring system 102 may direct the fluid flow from the riser 104 to be processed by the mud-gas separator in block 1012.

(Prior Art) FIG. 14 is a cross-section diagram of inductive coupler that may be useful in the marine tubular of the present invention. The figure is taken from FIG. 1 of U.S. patent application Ser. No. 17/559,619.

The above discussion is meant to be illustrative of principles and various exemplary embodiments of the present invention. Numerous variations and modifications will become apparent to those skilled in the art once the above disclosure is fully appreciated. It is intended that the following claims be interpreted to embrace all such variations and modifications.

The invention claimed is:

1. A telemetry tool, comprising:

a tube comprising a side wall comprising an exterior side wall surface spaced apart from an interior side wall surface;

the tube comprising first and second end connectors suitable for connecting the tube in a telemetry tool string;

the interior side wall surface forming a major axial bore;

the side wall further comprising a minor axial bore enclosed within a convex portion of the side wall;

the convex portion of the side wall comprising an annular groove housing an inductive coupler surrounding the minor axial bore and wherein the respective axial bores each intersect adjoining like axial bores through the first and second end connectors.

2. The telemetry tool of claim 1, wherein the exterior side wall surface is circular in cross section and the interior side wall surface comprises a substantially kidney shaped cross section forming the convex portion of the interior side wall surface.

3. The telemetry tool of claim 2, wherein the minor axial bore is oval shaped and enclosed within the convex portion of the side wall.

4. The telemetry tool of claim 2, wherein the convex portion of the side wall comprises an annular oval shaped groove housing an inductive coupler surrounding the minor axial bore.

5. The telemetry tool of claim 2, wherein the convex portion of the side wall comprises an annular seal gland comprising a seal disposed therein surrounding the annular groove.

6. The telemetry tool of claim 2, wherein an inductive coupler comprising a polymeric block comprising an MCEI trough comprising an electrically conductive wire coil is disposed within an annular groove within the convex portion of the side wall.

7. The telemetry tool of claim 6, wherein the inductive coupler within the convex portion of the side wall is in communication with a similarly configured inductive coupler at the opposite end of the tube by means of a cable running through the minor axial bore and a wire channel and connected to a wire coil.

8. The telemetry tool of claim 6, wherein the respective inductive couplers are in communication with sensors housed within the respective end connectors.

9. The telemetry tool of claim 8, wherein the sensors receive measurements and provide the measurements to a riser monitoring system.

10. The telemetry tool of claim 1, wherein the first and second end connectors each comprise a flange comprising an outside diameter greater than an exterior diameter of the tube.

11. The telemetry tool of claim 1, wherein the first and second end connectors each comprise a flange interface surface.

12. The telemetry tool of claim 11, wherein the respective flange interface surfaces each comprise an annular groove for housing an inductive coupler.

13. The telemetry tool of claim 12, wherein the respective inductive couplers comprising an annular polymeric block comprising an MCEI trough comprising an electrically conductive wire coil are disposed within the respective annular grooves.

14. The telemetry tool of claim 13, wherein the inductive couplers are in communication with each other by means of a cable running through the minor axial bore and the respective wire channels and connected to the respective wire coils.

15. The telemetry tool of claim 12, wherein the annular groove comprises an interior surface harder on the Rockwell C scale than the flanged interface surface.

16. The telemetry tool of claim 11, wherein the flanged interface surface comprises a wire channel connecting the annular groove with the minor axial bore.

17. The telemetry tool of claim 11, wherein the respective flange interfaces comprise an annular seal gland housing an annular seal surrounding the annular groove.

18. The telemetry tool of claim 11, wherein the flanged interface surface comprises a plurality of bolt holes.

19. The telemetry tool of claim 18, wherein the plurality of bolt holes are arranged in an annular symmetrical pattern.

20. The telemetry tool of claim 18, wherein the plurality of bolt holes are arranged in annular asymmetrical pattern.

* * * * *